US007225823B1

(12) United States Patent
Ransom et al.

(10) Patent No.: US 7,225,823 B1
(45) Date of Patent: Jun. 5, 2007

(54) COLLAPSIBLE ENCLOSURE WITH 3-DIMENSIONAL TRIM ELEMENTS

(76) Inventors: Robert M. Ransom, 8102 Coldwater Rd., Flushing, MI (US) 48433; Scott D. Wehner, 4407 W. Stanley Rd., Mt. Morris, MI (US) 48458; Ryan L. Kubica, 8470 Apple Blossom, Flushing, MI (US) 48433

( * ) Notice: Subject to any disclaimer, the term of this patent is extended or adjusted under 35 U.S.C. 154(b) by 389 days.

(21) Appl. No.: 10/806,492

(22) Filed: Mar. 23, 2004

(51) Int. Cl.
*E04H 15/40* (2006.01)

(52) U.S. Cl. ..... 135/126; 135/128; 135/115; 135/901; 43/1; 428/919

(58) Field of Classification Search ..... 135/125–126, 135/128, 115, 901; 446/476–478, 490; 428/919; 150/154, 166; 43/1; 182/187–188
See application file for complete search history.

(56) References Cited

U.S. PATENT DOCUMENTS

| | | | | |
|---|---|---|---|---|
| 586,145 | A | 1/1897 | Sievers | |
| 1,139,642 | A | 5/1915 | Cox | |
| 1,259,641 | A | 3/1918 | Livezey | |
| 1,274,645 | A | 8/1918 | Wasylowich | |
| 2,159,273 | A * | 5/1939 | Killinger | 135/125 |
| 2,351,142 | A | 6/1944 | Mitchell | |
| 2,992,503 | A | 7/1961 | Webb | |
| 3,675,667 | A | 7/1972 | Miller | |
| 3,848,352 | A | 11/1974 | Sayles | |
| 3,941,140 | A | 3/1976 | Beavers | |
| 3,960,161 | A | 6/1976 | Norman | |
| 3,990,463 | A | 11/1976 | Norman | |
| 4,026,312 | A | 5/1977 | Beavers | |
| 4,067,346 | A | 1/1978 | Husted | |
| 4,077,417 | A | 3/1978 | Beavers | |
| 4,224,754 | A | 9/1980 | Derryberry | |
| 4,265,261 | A | 5/1981 | Barker | |
| 4,364,193 | A | 12/1982 | Visco | |
| 4,375,488 | A * | 3/1983 | Hogan | 428/17 |
| 4,517,230 | A | 5/1985 | Crawford | |
| 4,581,837 | A | 4/1986 | Powlus | |
| 4,682,436 | A | 7/1987 | Ritson | |
| 4,794,717 | A | 1/1989 | Horsmann | |
| 4,825,578 | A | 5/1989 | Robinson | |
| 4,825,892 | A | 5/1989 | Norman | |
| 4,931,320 | A | 6/1990 | Leonard | |
| 5,010,909 | A | 4/1991 | Cleveland | |
| 5,013,375 | A | 5/1991 | Leonard | |

(Continued)

FOREIGN PATENT DOCUMENTS

| | | |
|---|---|---|
| DE | 3013178 A1 | 11/1981 |

(Continued)

*Primary Examiner*—Winnie Yip
(74) *Attorney, Agent, or Firm*—Young Basile

(57) ABSTRACT

The invention is a collapsible portable enclosure which is provided with 3-dimensional elements around portions of its perimeter. Various patterns, including but not limited to, pattern simulating leaves of various types of foliage are cut into a strip of fabric which is secured to the perimeter of the structure. The 3-dimensional elements protrude from the perimeter of the enclosure, move with the prevailing winds, and simulate the appearance and movement of leaves or foliage in the same environment. The enclosure further includes elastic strips to facilitate attachment of actual foliage to the exterior of the enclosure to improve its camouflage characteristics.

4 Claims, 3 Drawing Sheets

U.S. PATENT DOCUMENTS

| | | | | |
|---|---|---|---|---|
| 5,038,812 | A | 8/1991 | Norman | |
| 5,062,234 | A | 11/1991 | Green | |
| 5,137,044 | A | 8/1992 | Brady | |
| 5,222,513 | A | 6/1993 | Hilliard | |
| 5,249,592 | A | 10/1993 | Springer et al. | |
| 5,281,451 | A | 1/1994 | Reynolds | |
| 5,285,804 | A * | 2/1994 | Gretzmacher | 135/125 |
| 5,301,705 | A | 4/1994 | Zheng | |
| 5,394,897 | A | 3/1995 | Ritchey et al. | |
| 5,411,046 | A | 5/1995 | Wan | |
| 5,439,017 | A | 8/1995 | Brown | |
| 5,467,794 | A | 11/1995 | Zheng | |
| 5,476,561 | A | 12/1995 | Bylund et al. | |
| 5,486,385 | A | 1/1996 | Bylund et al. | |
| 5,579,799 | A | 12/1996 | Zheng | |
| 5,638,850 | A | 6/1997 | Hazinski et al. | |
| 5,695,835 | A | 12/1997 | Weber et al. | |
| 5,762,085 | A | 6/1998 | Punch | |
| 5,813,160 | A | 9/1998 | Thoelke | |
| 6,021,794 | A | 2/2000 | Guerra | |
| 6,164,005 | A | 12/2000 | Copeland | |
| 6,202,665 | B1 * | 3/2001 | O'Hare | 135/90 |
| 6,408,865 | B1 | 6/2002 | Bliss | |
| 6,510,922 | B1 * | 1/2003 | Hodnett | 182/187 |
| 6,694,995 | B1 * | 2/2004 | Ransom | 135/128 |
| 6,787,212 | B2 | 9/2004 | Strength et al. | |
| 6,941,961 | B1 * | 9/2005 | Eastman, II | 135/121 |
| 2002/0069904 | A1 | 6/2002 | Robinson | |
| 2006/0096630 | A1 * | 5/2006 | Eastman et al. | 135/115 |

FOREIGN PATENT DOCUMENTS

| | | | |
|---|---|---|---|
| FR | 2635136 | A3 | 2/1990 |

* cited by examiner

COLLAPSIBLE ENCLOSURE WITH 3-DIMENSIONAL TRIM ELEMENTS

FIELD OF THE INVENTION

The invention pertains to portable and collapsible enclosures, such as tents, and more particularly, to such enclosures bearing 3-dimensional camouflage or background matching patterns.

BACKGROUND OF THE INVENTION

Portable enclosures, such as tents, have been used as blinds and shelters since the beginning of recorded time. The structure and appearance of such enclosures is as varied as human culture.

More recently, easily portable, lightweight, durable and affordable enclosures have become a desirable accessory for many outdoor recreational activities, including camping and hunting. The widespread availability of modern lightweight structures and fabrics has resulted in the availability of literally hundreds of new designs for portable enclosures. Among the many popular current styles for tents and hunting blinds are the so-called "collapsible" structures which utilize a spring-like framework which can be easily collapsed and folded for transportation and storage. Such popular designs are typified in, for example, U.S. Pat. No. 3,675,667, issued to Miller.

It is also well known to apply camouflage or background matching patterns or colors to portable enclosures. It is desirable, particularly for hunters, that a tent or hunting blind be as inconspicuous as possible in its environment, and the development of realistic camouflage patterns for such enclosures (as well as other articles) has resulted in the widespread availability of enclosures which are almost invisible in specific backgrounds. For example, such enclosures may be provided with a typical woodland's camouflage pattern, in which the enclosure's fabric bears a depiction of typical mid-summer forest greenery, including the usual mix of deciduous and coniferous foliage, underbrush and grasses which might be found in a Midwestern woodland. Enclosures bearing particular camouflage patterns may also benefit by having interchangeable coverings, such as those taught by our currently pending United States patent application entitled "Collapsible Enclosure With Interchangeable and Reversible Covering Elements", Ser. No. 10/025,279.

Use of existing enclosures in the outdoor environment has been successful However, it is apparent from such use that significant improvements could be achieved by more effectively blending such devices into the woodland's background by adding 3-dimensional elements, particularly around the perimeter of the device. The rationale for this improvement is that even when provided with otherwise effective camouflage patterns, it has been discovered that the well-defined edges of such enclosures is discernable to the eye, and particularly noticeable to certain species of wildlife.

There is a need, therefore, for a camouflage-type enclosure which is provided with means for interrupting the otherwise curvilinear or linear edges and planar sides of the enclosure, particularly in relation to an environment of varied foliage types.

SUMMARY OF THE INVENTION

The invention, therefore, is a collapsible portable enclosure which is provided with 3-dimensional elements around portions of its exterior. Such 3-dimensional elements may be readily attached to the exterior of existing products, as well as incorporated into the structure of the product at the time of original manufacture. Various patterns, including but not limited to patterns simulating leaves of various types of foliage are cut into strips of fabric which are secured to the exterior of the structure. By selecting an appropriate weight for the material, the 3-dimensional elements are allowed to protrude from the exterior of the enclosure, and to move with the prevailing winds, simulating the movement of leaves or foliage in the same environment. In addition, means may be provided to facilitate attachment to the enclosure of actual foliage, specifically, utilization of elastic elements affixed to the structure for holding branches, grass and the like.

DETAILED DESCRIPTION OF THE INVENTION

Figure 1:
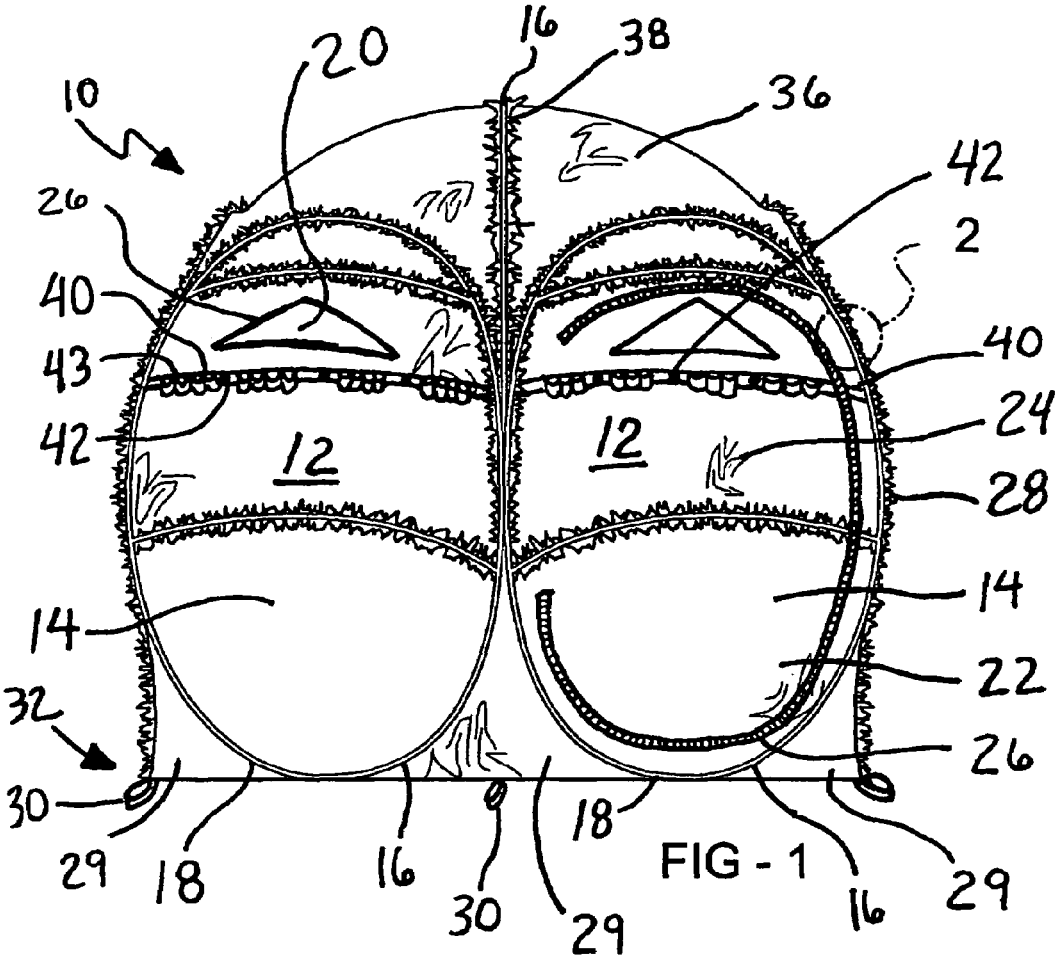
FIG. 1 is a perspective view of the invention showing the enclosure, typical 3-dimensional elements and attachment means.

As shown in FIG. 1, one embodiment of the enclosure 10 is designed with sufficient interior volume to accommodate one or more occupants. The overall dimensions of the enclosure 10 are selected to insure the relative comfort of the occupants and accommodate the desired activity which, by way of example in this application, is of a size suitable for hunting. The enclosure 10 as shown in FIG. 1, is supported by a plurality of frame members 18 surrounding fabric panels 12. The frame members 18 are typically of resilient or spring-like materials, such as spring steel or fiber-reinforced plastic, which are strong and durable, yet lightweight. In one embodiment of the enclosure 10 flexible material such as fabric bears a visible pattern 24 selected to camouflage the enclosure 10 in the surrounding environment. The frame members 18 and panels 12 form walls 14 having a perimeter sleeve 16 enclosing each frame element 18. Sleeves 16 are typically formed of the same flexible material such as fabric utilized for panels 12, and are sewn to the perimeter of panels 12, providing tension to panels 12 when frame members 18 are placed within sleeves 16. One or more panels 12 may also feature a port 20 having a closure 26, such as a zipper, hook and loop fastener, or the like, allowing the occupant of the enclosure 10 to observe and, if desired, discharge a weapon through an open port 20. Port 20 can be closed for protection of the occupant from the elements, or from observation by game animals in the environment. Flexible material such as fabric gores 29 interconnect panels 12. The interior of the enclosure 10 may be provided with a floor (not shown).

Another panel 12 of the enclosure 10 is typically provided with an opening door 22, likewise fitted with a closure 26. The enclosure may consist solely of a plurality of walls 14, but may also include apex flexible material such as fabric 36 to form a top or covering over the completed enclosure 10. In this embodiment, the lower edges of apex material 36 is joined to the upper edges of panels 12, thereby creating a complete enclosure 10. Apex material 36 may be provided with support frame elements 38 captured by sleeves 16 which hold apex material 36 in a dome-like configuration.

In one embodiment, the enclosure 10 is also provided with a plurality of loops 30 which are suitable for engaging a plurality of stakes 32 to hold the enclosure 10 against the ground on which the enclosure 10 is erected.

To provide improved blending of the appearance of the enclosure 10 into the background environment, the sleeves 16 of each panel 12 are provided with a fringe 28 of flexible material such as fabric, each fringe comprising a plurality of cutout elements 34. Preferably, the fringe 28 is secured to the sleeves 16, since said sleeves 16 form the outermost edges of the enclosure 10 and define the enclosure profile against the surroundings.

Figure 2:
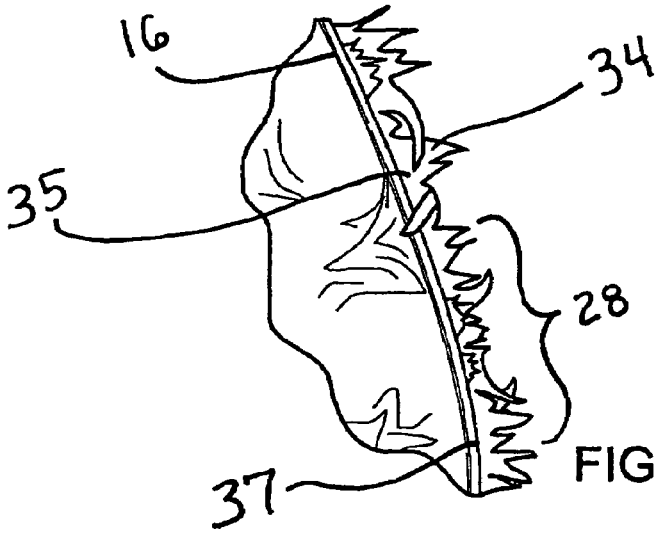
FIG. 2 is a detailed view of the 3-dimensional elements affixed to the exterior of the enclosure.

As shown in more detail in FIG. 2, cutout elements 34 are cut from a strip 35 of flexible material, and bear a camouflage pattern which is the same as the pattern 24 which forms the overall pattern of each panel 12 of the enclosure 10. Preferably, each element 34 has a size and shape typical of the leaf elements in the surrounding environment. It is also effective, however, to use simple shapes, such as triangles, circles, or squares in place of leaf-shaped cutouts. Cutout elements 34 remain attached to the sleeve 16 by hinge section 37 which allows each leaf element 34 to move in relation to sleeve 16.

Strips 35 may be attached to the wall sleeve 16 by sewing or adhesives during the manufacturing process. In the alternative, strip elements 35 may be provided with an adhesive backing material, or a removable fastener allowing the strip element 35 to be selectively added to or removed from the exterior of pre-existing enclosure 10. Further, different camouflage patterns may be selected for strip element 35, allowing an enclosure 10 to be customized for different outdoor environments.

To further enhance the camouflaged quality of the erected enclosure in any particular environment, it is also desirable to temporarily affix to the exterior of the enclosure 10 leaves, grasses, branches, hay, straw or other natural vegetation. Enclosure 10 is provided with elastic strips 40 which are affixed to side panels 12 by stitching, adhesives or other well known means at selected points 42 across the surface of side panels 12. The elastic strips so affixed create loops 43 in which such natural vegetation may be easily inserted and held in position by the elasticity of the strips 40. This temporary addition of natural foliage to the exterior of the enclosure 10 greatly enhances the blending of the enclosure into the surrounding environment. Further, by virtue of the fact that the vegetation so placed is not permanently secured, the vegetation may be readily removed and discarded when folding of the enclosure 10 for transport is required.

Elastic strips 40 may be placed at a variety of locations in the side panels 12, and may also be placed on the apex material 36.

Figure 3A:
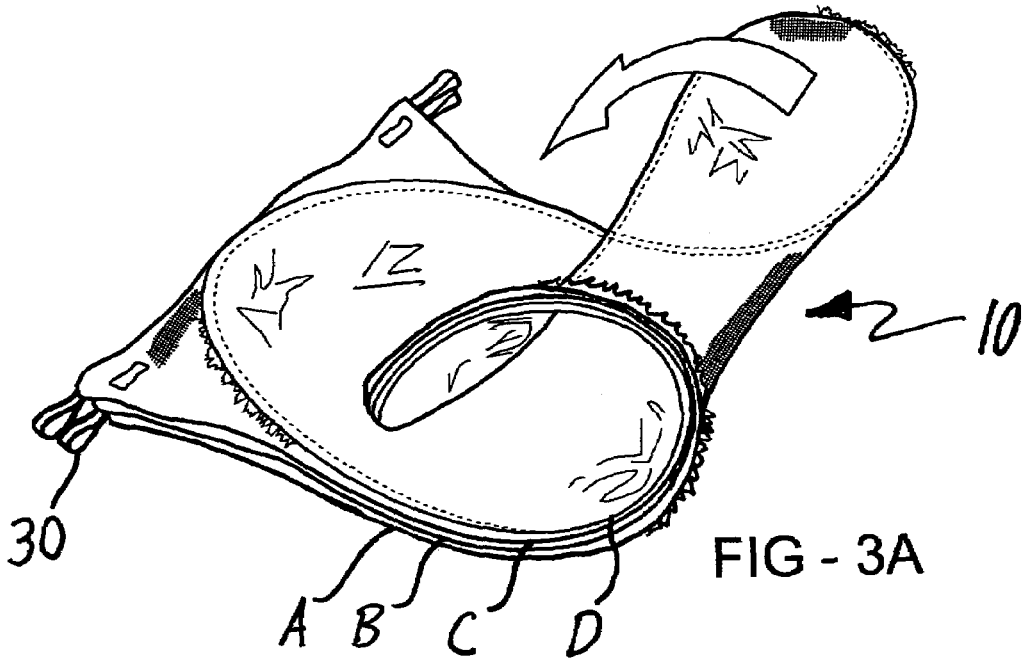
FIGS. 3A–3E are perspective views showing the method of collapsing and storing the completed enclosure.
Figure 3B:
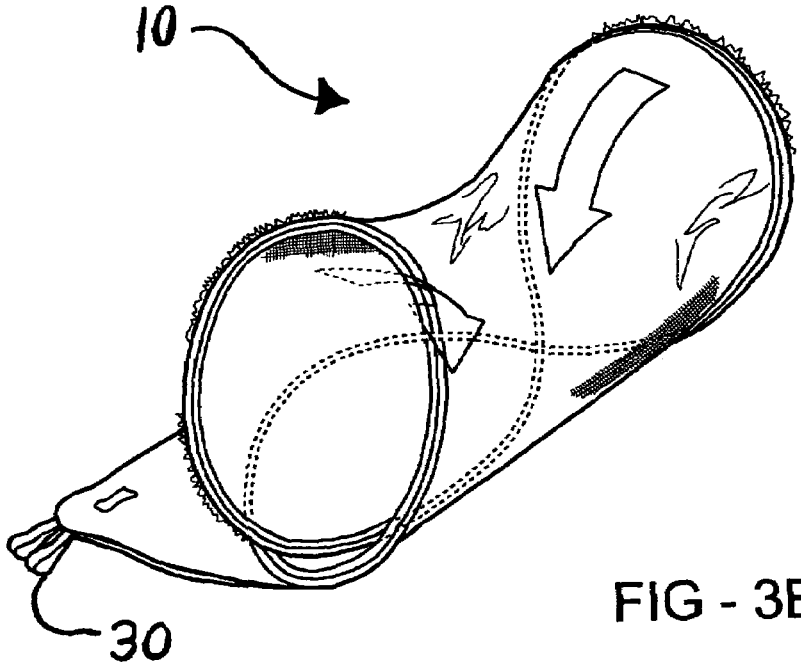
Figure 3C:
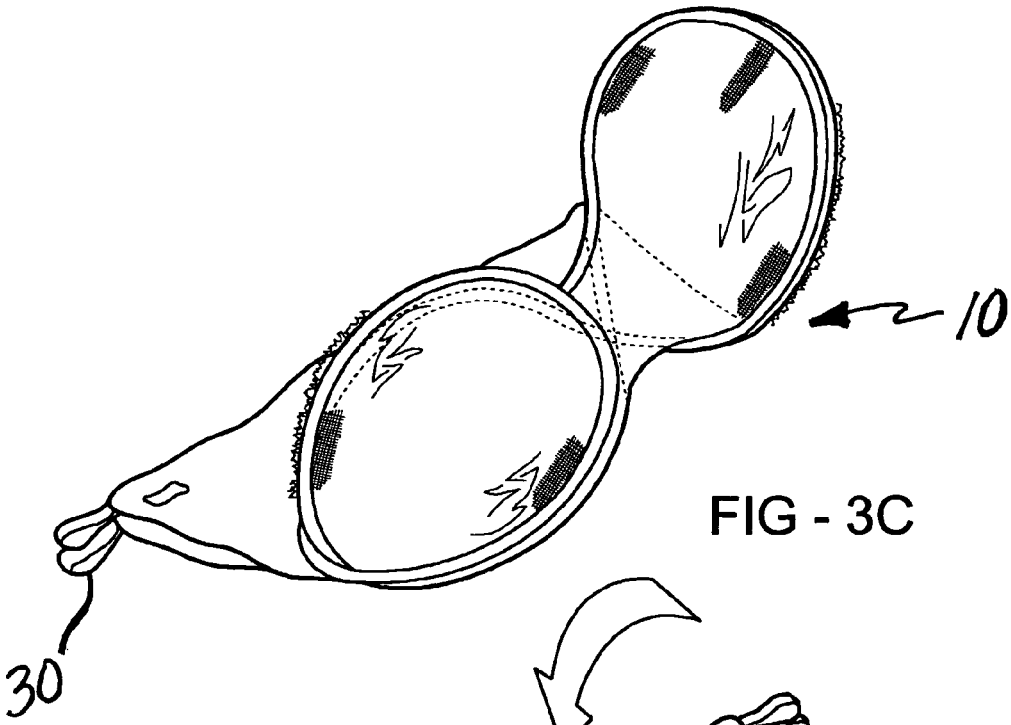
Figure 3D:
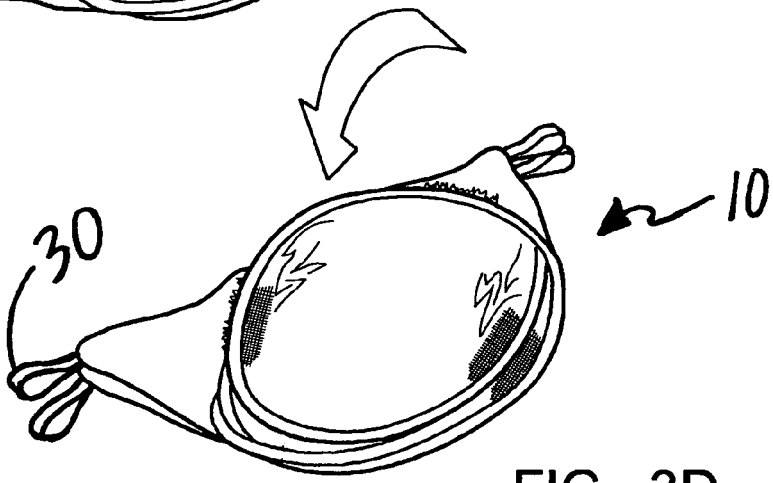
Figure 3E:
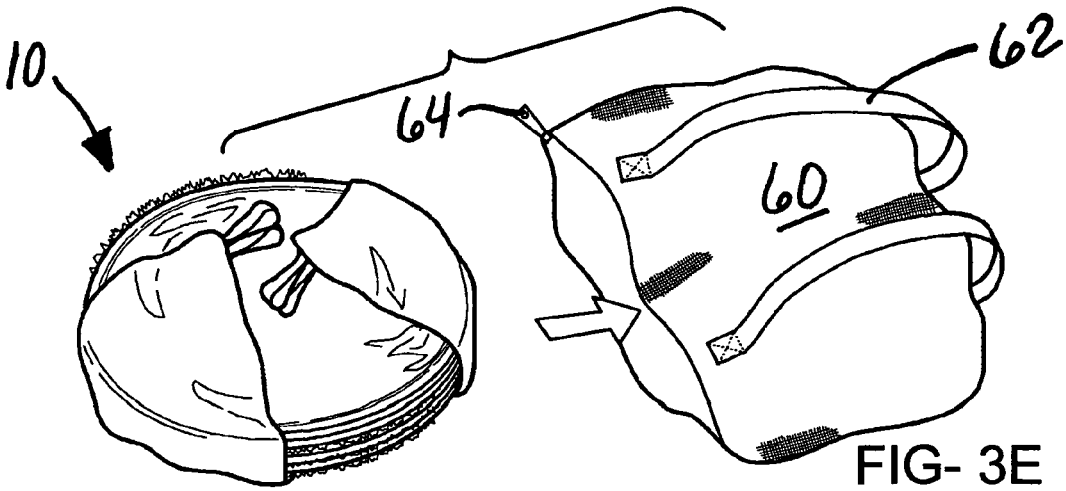

The collapsing of the enclosed frame is accomplished as shown in FIGS. 3A–3D. This process can be performed quickly and easily. In the example shown, the enclosure 10, when erected, presents a quadrilateral enclosure having a top section. Inasmuch as the material of the side panels 12 and apex 36 is flexible, the enclosure may be flattened as shown in FIG. 3A by urging side panel A and side panel B and side panel C against side panel D. The enclosure so collapsed is folded against itself again, so that the four side panels of the quadrilateral enclosure are in stacked configuration. Thereafter, as shown in FIG. 3A, the superimposed side panel frame members are folded into a U-shaped configuration to initiate the folding process. A second twist as shown by the arrow in FIG. 3B results in the formation of three overlapping coils of resilient material, each having a substantially smaller diameter than the diameter of the frame members when erect. The three coils are shown in FIG. 3C. When the three coils are superimposed, they form a compact package as shown in FIG. 3D which may be easily transported. In the preferred embodiment, the invention is provided with container 60 adapted to enclose and restrain the collapsed enclosure of the framework. Container 60 may be provided with one or more pockets (not shown) in which to store loose items, such as the stakes 32. Further, the container 60 may be provided with shoulder straps 62 and closure 64 to facilitate carrying. In this fashion, the user may conveniently carry the enclosure 10 in the form of a backpack.

We claim:

1. A portable, collapsible enclosure, comprising:

a plurality of flexible side panels, each side panel being coupled together defining a fabric sleeve having a frame disposed therein, said frame having at least one foldable supporting element, which, when unfolded, provides rigidity and shape to the side panel; and at least one elongate strip of flexible material having an elongate hinge section and a plurality of cutout elements, wherein said elongate hinge section is continuously connected to at least one of said fabric sleeves along the entire length of said elongate strip, and said cutout elements are of sizes and shapes that simulate foliage.

2. A portable, collapsible enclosure, comprising:

a plurality of flexible side panels, each side panel being coupled together defining a fabric sleeve having a frame disposed therein, said frame having at least one foldable supporting element, which, when unfolded, provides rigidity and shape to the side panel;

at least one elongate strip of flexible material having an elongate hinge section and a plurality of cutout elements, wherein said elongate hinge section is continuously connected to at least one of said fabric sleeves along the entire length of said elongate strip, and said cutout elements are of sizes and shapes that simulate foliage; and means for removably attaching vegetation to at least one of the side panels.

3. The portable, collapsible enclosure of claim 2, wherein the means for removably attaching vegetation to at least one of the side panels are elastic strips.

4. A portable, collapsible enclosure, comprising:

a plurality of flexible side panels, each side panel being coupled together having a perimeter defined by a sleeve having a foldable supporting element disposed therein, wherein said foldable supporting element provides rigidity and shape to the side panel when unfolded; and at least one elongated strip of flexible material having a first longitudinal edge and an opposing second longitudinal edge, wherein said first longitudinal edge is connectable to at least one of said side panels along said sleeve, and said second longitudinal edge has a plurality of cutout elements defined therein, and said cutout elements are of sizes and shapes that simulate foliage.

* * * * *